US010563367B2

(12) United States Patent
Reid

(10) Patent No.: US 10,563,367 B2
(45) Date of Patent: Feb. 18, 2020

(54) PORTABLE ROADSIDE BARRIER

(71) Applicant: Milan Reid, Wilmington, DE (US)

(72) Inventor: Milan Reid, Wilmington, DE (US)

( * ) Notice: Subject to any disclaimer, the term of this patent is extended or adjusted under 35 U.S.C. 154(b) by 0 days.

(21) Appl. No.: 15/996,059

(22) Filed: Jun. 1, 2018

(65) Prior Publication Data

US 2018/0347128 A1 Dec. 6, 2018

Related U.S. Application Data

(63) Continuation-in-part of application No. PCT/US2016/064640, filed on Dec. 2, 2016.

(60) Provisional application No. 62/344,040, filed on Jun. 1, 2016, provisional application No. 62/262,350, filed on Dec. 2, 2015.

(51) Int. Cl.

| | |
|---|---|
| ***E01F 13/00*** | (2006.01) |
| ***E01F 13/02*** | (2006.01) |
| ***G09F 13/16*** | (2006.01) |
| ***G09F 13/20*** | (2006.01) |
| *E01F 9/646* | (2016.01) |

(52) U.S. Cl.

CPC ..... *E01F 13/02* (2013.01); *G09F 13/16* (2013.01); *G09F 13/20* (2013.01); *E01F 9/646* (2016.02)

(58) Field of Classification Search

CPC ..... E01F 9/646; E01F 13/02; G09F 13/16; G09F 13/20

USPC ..... 404/6, 9; 116/63 P

See application file for complete search history.

(56) References Cited

U.S. PATENT DOCUMENTS

| | | | | |
|---|---|---|---|---|
| 3,086,740 A * | 4/1963 | Hatton | E01F 13/02 182/155 |
| 3,145,766 A | 8/1964 | Wickham et al. | |
| 3,802,667 A | 4/1974 | Kanan | |
| 4,756,384 A * | 7/1988 | Maddox | B25H 1/06 116/63 P |
| 5,103,384 A | 4/1992 | Drohan | |
| 5,544,614 A * | 8/1996 | Cushman | E01F 13/02 116/28 R |
| 6,928,952 B2 * | 8/2005 | Garcia | E01F 9/688 116/63 C |
| 7,287,929 B1 * | 10/2007 | Sokolowski | G08B 21/12 404/6 |
| 7,688,222 B2 * | 3/2010 | Peddie | G08G 1/096783 116/63 P |

(Continued)

OTHER PUBLICATIONS

International Search Report and Written Opinion for Internatoinal Application No. PCT/US2016/064640, dated Feb. 17, 2017, 10 pages.

(Continued)

*Primary Examiner* — Raymond W Addie
(74) *Attorney, Agent, or Firm* — RatnerPrestia

(57) ABSTRACT

A roadside barrier includes a frame characterized by a plurality of legs and an assembly extending between the legs. The frame and the assembly have a first surface and a second surface. The frame is configurable to provide a barrier separating a vehicle or individual from vehicular traffic. The roadside barrier further includes one or more visible indicators disposed on at least the first surface of the assembly. The one or more visible indicators are arranged to form one or more indicia visible to vehicular traffic even in an absence of daylight. The one or more indicia include a light-reflective element, a light-emitting element, or a combination thereof.

10 Claims, 11 Drawing Sheets

(56) References Cited

U.S. PATENT DOCUMENTS

| | | | | |
|---|---|---|---|---|
| 7,874,090 | B2 * | 1/2011 | Flagg | G09F 15/0068 116/63 P |
| 2003/0196360 | A1 | 10/2003 | Colip | |
| 2004/0016156 | A1 | 1/2004 | Fernandez et al. | |
| 2005/0063778 | A1 * | 3/2005 | Connors | E01F 13/02 404/9 |
| 2010/0202828 | A1 * | 8/2010 | Ashmead | E01F 13/02 404/6 |
| 2014/0168956 | A1 * | 6/2014 | Burnell | E01F 13/02 362/152 |
| 2014/0363229 | A1 * | 12/2014 | Lumsden | E01F 13/06 404/6 |

OTHER PUBLICATIONS

International Preliminary Report on Patentability for International Application No. PCT/US2016/064640, dated Jun. 5, 2018, 9 pages.

* cited by examiner

PORTABLE ROADSIDE BARRIER

CROSS-REFERENCE TO RELATED APPLICATIONS

This application is a continuation-in-part of PCT International Application No. PCT/US2016/064640 filed Dec. 2, 2016, which claims priority to U.S. Provisional Application No. 62/262,350 filed on 2 Dec. 2015, and U.S. Provisional Application No. 62/344,040 filed on 1 Jun. 2016, all of which are entitled PORTABLE ROADSIDE BARRIER, the contents of each application being incorporated herein by reference in their entirety for all purposes.

SUMMARY OF THE INVENTION

The invention relates generally to portable barriers, such as for use along a roadside.

In accordance with one aspect, the roadside barrier includes a frame characterized by a plurality of legs and a plurality of supporting members extending between the legs. The frame and the supporting members have a first surface and a second surface. The frame is configurable to provide a warning barrier disposed between vehicular traffic and a vehicle or individual, such as may be useful for deployment near a disabled vehicle on the side of the road being attended to by an individual. The roadside barrier further includes one or more visible indicators disposed on at least the first surface of one or more of the plurality of supporting members. The one or more visible indicators are arranged to form one or more indicia visible to vehicular traffic even in an absence of daylight. The one or more indicia include a light-reflective element, a light-emitting element, or a combination thereof.

It is to be understood that both the foregoing general description and the following detailed description are exemplary, but are not restrictive, of the invention.

BRIEF DESCRIPTION OF THE DRAWINGS

Embodiments of the invention are best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale unless otherwise indicated. On the contrary, the dimensions of the various features may be expanded or reduced for clarity. Included in the drawings are the following figures.

DETAILED DESCRIPTION OF THE INVENTION

Figure 1:
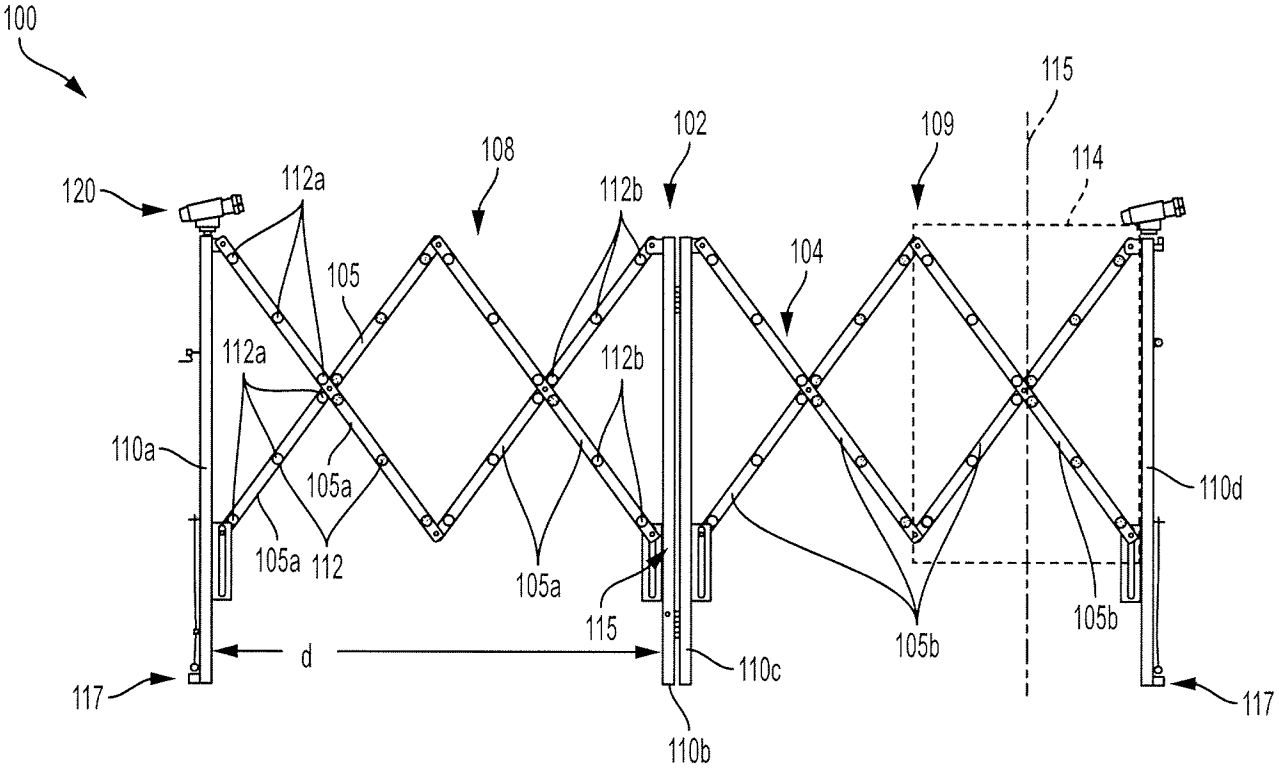
FIG. 1 is a schematic illustration of an exemplary roadside barrier according to aspects of the present invention.

FIG. 1 depicts a schematic illustration of an exemplary portable roadside barrier 100. Portable roadside barrier 100 includes a frame 102 which includes a plurality of legs 110*a*-100*d* and a plurality of supporting members 105 extending between legs 110*a* and 110*b* and between legs 110*c* and 110*d*. As illustrated in the figures, roadside barrier has a form similar to what is commonly referred to as an "extension gate" or "accordion gate." Frame 102 and supporting members 105 have a first surface (facing toward the viewer of the page) 104 and a second surface (not shown, but opposite first surface 104, and facing into the page).

Returning to FIG. 1, one or more visible indicators 112 may be disposed on at least first surface 104 of one or more of plurality of supporting members 105. One or more visible indicators 112, 150 may be arranged to form one or more indicia visible to vehicular traffic even in an absence of daylight. For example, each of the one or more indicia may comprise a light-reflective element, a light-emitting element, or a combination thereof.

Figure 3:
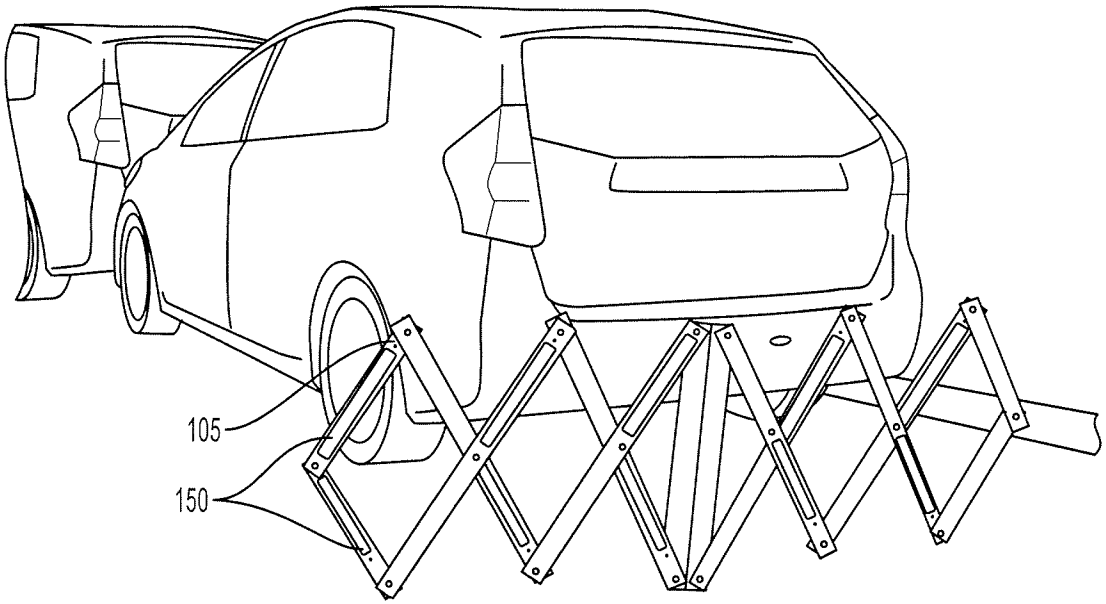
FIG. 3 is a photograph, taken in an absence of daylight, of an exemplary roadside barrier having light reflective visual indicia, with the barrier in an extended configuration with an approximately 180 degree angle between first and second sections of the barrier.
Figure 4:
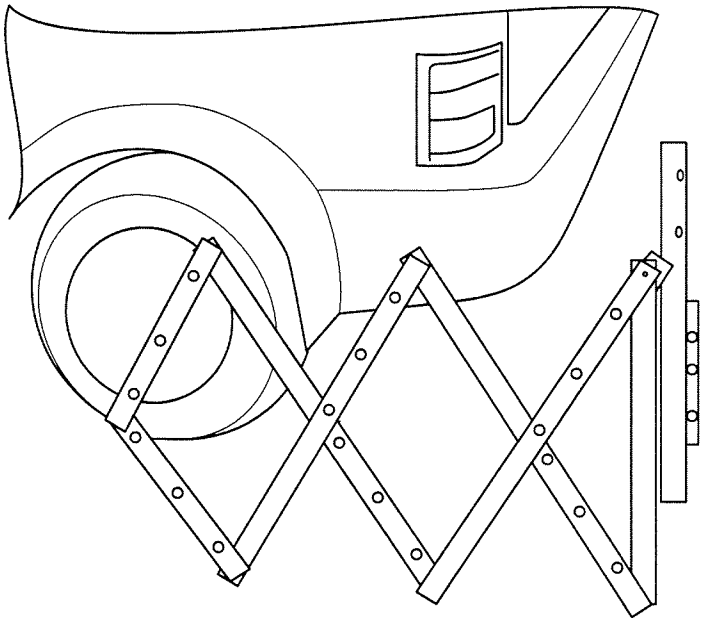
FIG. 4 is another photograph, taken in an absence of daylight, of another exemplary roadside barrier having light-emitting visual indicia, with the barrier in an extended configuration with an approximately 90 degree angle between first and second sections of the barrier.

Turning briefly to FIGS. 3 and 4, frame 102 is configurable to provide a barrier between vehicular traffic (not shown) and a vehicle or individual, such as an individual working on a disabled vehicle on the side of the road.

Figure 2:
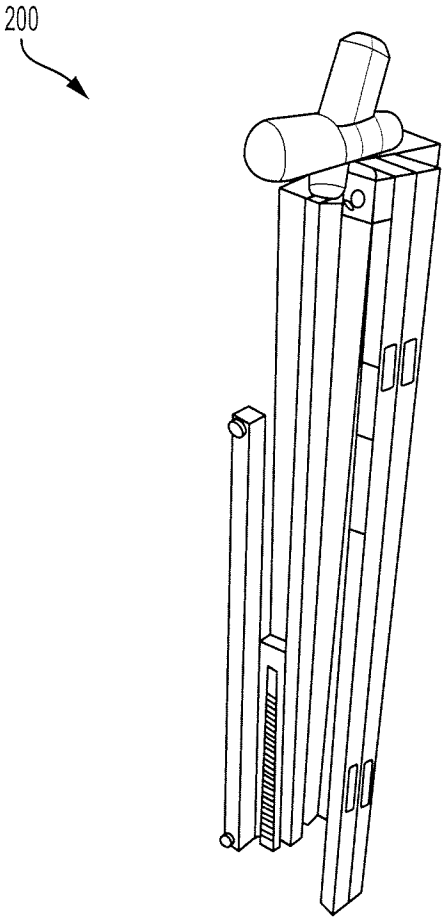
FIG. 2 is a photograph of an exemplary prototype roadside barrier in a collapsed configuration.

Comparing the figures, the roadside barrier preferably has a collapsed configuration (FIG. 2) and at least one, but preferably a plurality of extended configurations (e.g. FIGS. 1, 3, 4, 6). In particular, the roadside barrier may have a plurality of extended configurations in which a distance, d, between two of the plurality of adjacent legs 110*a* and 110*b* is at a maximum in a fully-extended configuration, and the distance, d, between the adjacent legs is less than the maximum in one or more partially-extended configurations.

In preferred embodiments, depicted in FIGS. 3 and 4, the visual indicia 112, 150 is positioned on a portion of intersecting supporting members 105 so as to form an indicating arrow visible to oncoming vehicular traffic when the roadside barrier is in one or more of the extended configurations.

In a preferred embodiment, frame 102 also includes a first section 108 comprising at least a first set of legs 110*a,b* and a first set of supporting members 105*a* therebetween, and a second section 109 comprising at least a second set of legs 110*c,d* and a second set of supporting members 105*b* therebetween. First section 108 and second section 109 may be joined by a hinge 115. Although shown with only two sections, it should be understood that only one or more than two sections may be provided.

As depicted in FIG. 4, hinge 115 is preferably configurable to permit first section 108 and second section 109 to be arranged at an angle of at least up to 90 degrees relative to one another. As depicted by FIG. 3, hinge 115 is also preferably configurable to permit first section 108 and second section 109 to be arranged at an angle of at least up to 180 degrees relative to one another.

Portable roadside barrier 100 may also include one or more stabilizing members 117 configurable to permit barrier 100 to stand in an upright position. One or more stabilizing members 117 may be arranged at the base of, and perpendicular to, one or more of the plurality of legs, such as legs 110*a* and 110*d*, as shown in FIG. 1.

Figure 5:
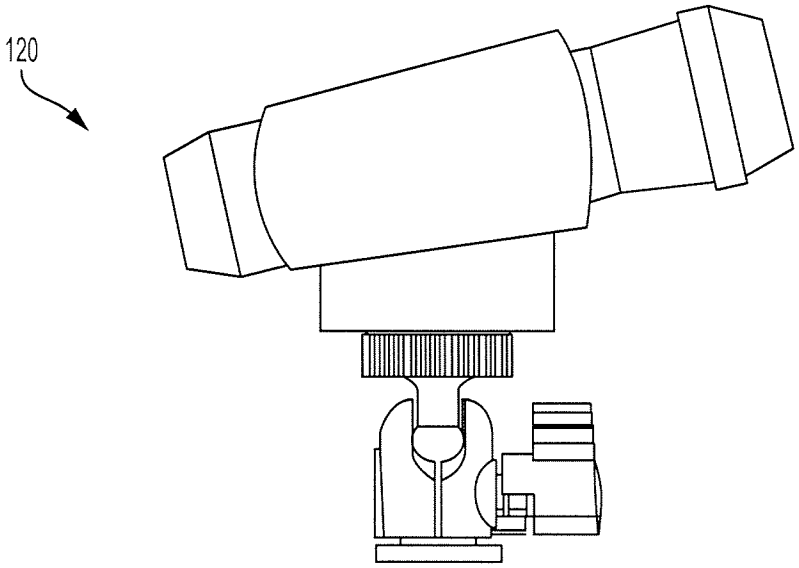
FIG. 5 is a schematic illustration of an exemplary receptacle for receiving an accessory, and an exemplary accessory in the form of a worklight.
Figure 6:
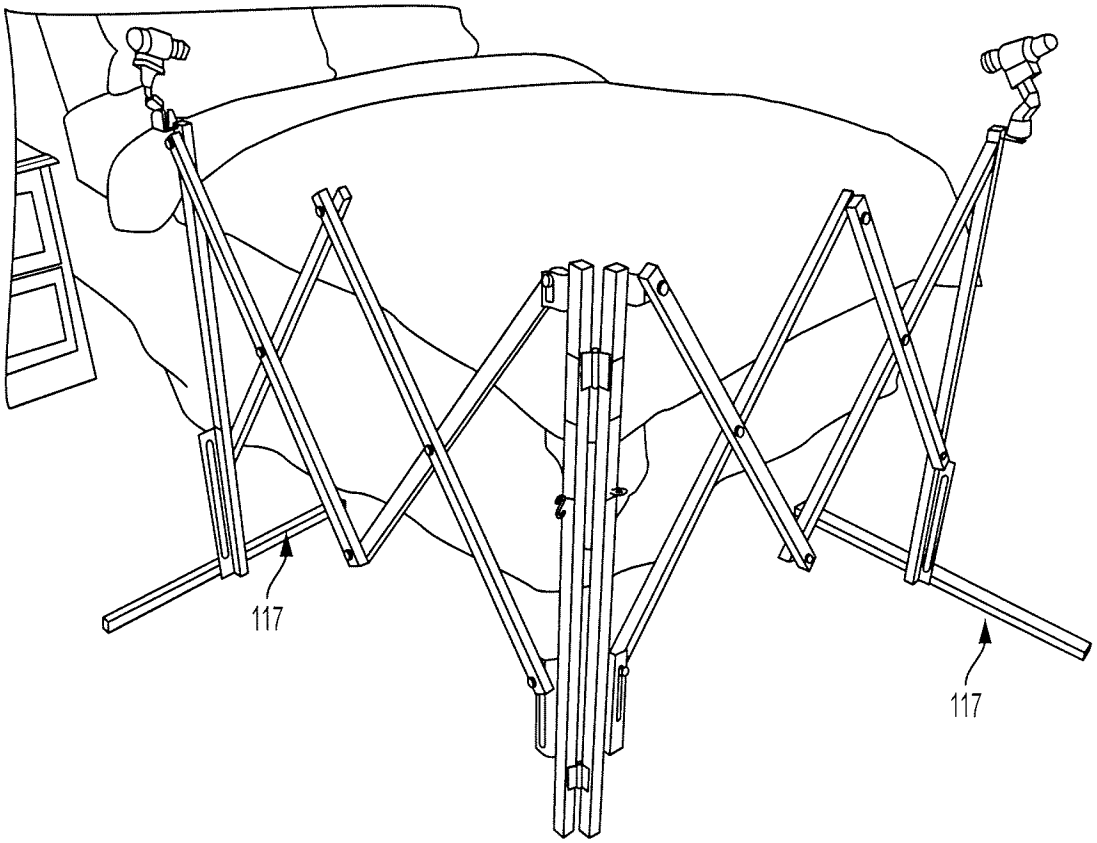
FIG. 6 is a photograph, taken in ambient light, of the exemplary roadside barrier structure as shown in FIGS. 2-4, without visible indicators, in the extended configuration with an approximately 90 degree angle between first and second sections of the barrier.

Portable roadside barrier 100 may also include one or more receptacles 120 attached to frame 102 for receiving an accessory. The accessory may be, for example a light, such as a worklight or a flashlight. Turning to FIG. 5, receptacle 120 is configurable to adjust a beam direction of the flashlight, such as with a ball joint that can be tightened by hand to secure the receptacle in a desired position with the beam directed in a desired direction. Barrier 100 is configurable so that visible indicators 112, 150 are facing in a first general direction (e.g. so that they are visible to oncoming vehicular traffic) and the one or more receptacles 120 is configurable so that the beam of the flashlight points in a direction away from the first general direction (e.g. toward the car to provide light to illuminate a desired area of the car, such as in a first specific direction to illuminate the trunk area for unpacking a spare tire and tire changing tools, and adjustable to a second specific direction to illuminate the area of the car with the flat tire to be changed). It should be understood that both the first and second specific directions as discussed above may or may not require an adjustment of the light (depending upon the width of the beam), but if adjustment between the first and second specific directions is required, both would be considered to be pointing opposite the general direction of the oncoming traffic.

As depicted in the figures, each of the plurality of supporting members 105 is preferably connected at one end to one of the legs and at the opposite end to one of the other supporting members, and overlaps another supporting member at its midpoint to form one or more X shapes 114 (shown in FIG. 1). Visible indicators 112, 150 are positioned along one side or the other of the line 115 bisecting the X shape to form the arrow shapes > or < that point left or right, respectively, as viewed by oncoming traffic. It should be understood that each set of supporting members between each pair of legs may comprise four supporting members that form two X shapes between each pair of legs as illustrated herein, or fewer or more such supporting members forming fewer or more such X shapes between each pair of legs. It should also be understood that additional legs may be provided, such as between each adjacent X shape.

Thus, portable roadside barrier 100 is configurable with visible indicators 112, 150 configured to form an arrow shape pointing in either a left-pointing direction or a right-pointing direction. As depicted in FIG. 1, in one embodiment, certain sets of light-emitting visual indicators 112*a* (white dots) form arrows pointing in the right direction, and other sets of light-emitting visual indicators 112*b* (black dots) form arrows pointing in the left direction. Thus, one embodiment may comprise an electrical switch (not shown) having at least a first switch position configured to turn on only the right pointing visual indicators, a second switch position configured to turn on only the left pointing visual indicators, and an third, off position. Or, each set of lights may have its own on/off switch. Or each individual light may be capable of being turning on or off. Or, in a preferred embodiment, the lights may be connected to a controller so that the lights can be set to illuminate in any pattern desired, including in a sequential fashion to provide arrows that sequentially light up in the desired direction to create the illusion of a moving arrow from left to right or right to left. A configuration with right and left arrows on a single side permits use of hinges 115 connecting the first and second sections 108 and 109 with freedom of motion along only a 180-degree angle.

In another embodiment (not shown), both first surface 104 and the second (opposing) surface have visible indicators 112, 150, and the indicator arrows formed by the visible indicators point in one direction on one surface and the opposite direction on the opposing surface. Such a configuration may be facilitated by the use of a hinges connecting the first and second sections 108 and 109 having a freedom of motion along essentially a nearly 360-degree angle.

It should be understood that although illustrated in separate embodiments, one having light-reflecting indicators 150 and the other having light-emitting indicators 112, both light-reflecting and light-emitting indicators may be present in a single unit. Because light reflecting indicators cannot be turned on and off, embodiments having visible indicators for both left and right arrows on the same side of the barrier may include covers for blocking the indicators that form the "wrong-pointing" arrow from reflecting light. Such covers may be attached, for example, by microloop/microhook fasteners (e.g. VELCRO® fasteners), snaps, buttons, or any other connection means known in the art. In another embodiment (not shown), the covers may be permanently connected to supporting members 105 relative to each indicator (e.g. such as in the form of an extensible sheath for the member 105) with a first position covering the indicator and a second position uncovering the indicator, held in place by any means known in the art (e.g. snaps, buttons, elastic bands, and the like).

In another embodiment, not shown, the visible indicators may be arranged to form an arrows in only one direction, and the gate configurable to cause those arrows to point to the left or to the right. For example, the gate may have a first configuration in which the first ends of the respective legs are positioned adjacent to or on the ground, and a second configuration in which opposite ends of the respective legs are positioned adjacent to or on the ground, such that the second configuration is upside down relative to the first configuration. In such a configuration, stabilizing members may be provided at both the top and bottom of selected legs, or the legs may be configured to interface with a single set of stabilizing members that can be connected to either end of the legs.

Figure 7:
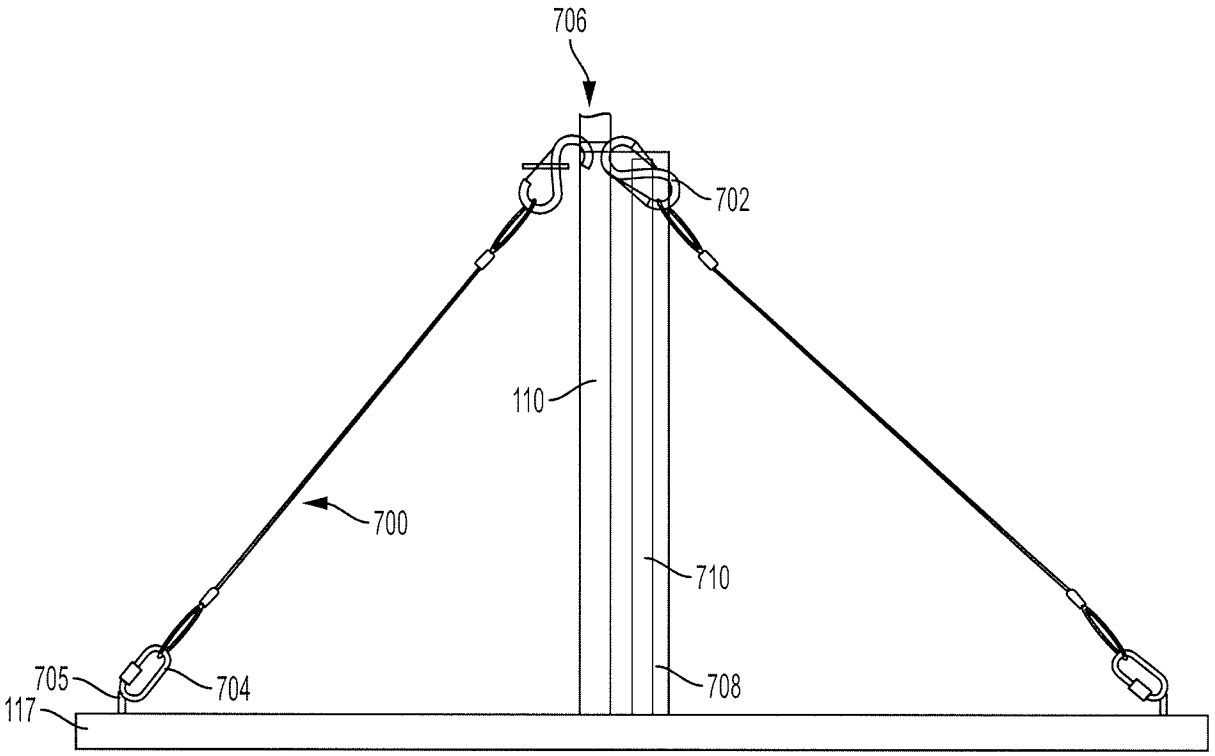
FIG. 7 is a schematic illustration of an exemplary end leg and stabilizing member, with retaining wires.

Some embodiments may further comprise a retaining member, such as a wire 700 that connects the ends of the stabilizing members to a connection point 706 on the leg, as shown in FIG. 7. As illustrated in FIG. 7, in one embodiment, carbineers 704 attached to one end of wire 700 are removably connectable to eyelets 705 attached to the stabilizing members, and S-hooks attached to the opposite ends of wire 700 are removably connectable to an eyelet 706 attached to leg 110. Also attached to leg 110 is a guide 708 having a slot 710 for receiving a bolt (not shown) attached at approximately a midpoint of the stabilizer 717 for permitting the stabilizer to rotate 90 degrees about the bolt as the bolt slides between the deployed position as shown in FIG. 7 (with the bolt near the bottom of the slot) and a collapsed position (not shown, with the bolt at or near the top of the slot), with the stabilizer oriented parallel to the leg 110 in a fully collapsed position. A wing nut (not shown) may be used for tightening the bolt against the guide to prevent movement when in a desired position. It should be understood that the hardware elements and their arrangement shown and discussed herein are only exemplary, and any combination of hooks, carabineers, hooks of any shape, eyelets, and the like may be used for making the desired connections. It should also be understood that the retaining wire may be eliminated altogether in some embodiments.

In another embodiment, depicted in FIGS. 8A-8E, roadside barrier 800 comprises two telescoping legs 802 with an accordion assembly 820 disposed therebetween. Each telescoping leg 802 comprises a lower stanchion 804 and an upper stanchion 806. The lower stanchion has a set of, preferably three, folding feet 808, which rotate about pin 809 to allow them to be disposed in a folded position when rotated in the direction of arrow A to be parallel to the stanchion for storage, or disposed in a deployed position perpendicular to the lower stanchion, as depicted in the Figures. The legs may be connected to the lower stanchion by a connection that is spring-loaded or otherwise biased or delimited to retain the legs in the desired position when deployed in that position, using any mechanism known in the art for providing such functionality.

Accordion assembly 820 comprises a plurality of members 822 that secured to one another with rotating pin connections 824, as are well known in the art. As depicted in FIG. 8B, each upper stanchion 806 comprises a slotted guide tab 830 for receiving a translating rotating pin connection from the lower end of each connector 822*a, b* to secures lower end of those members to the stanchion, and a rotating pin connection to secure the upper end of members 822*c, d* to the stanchion. Although depicted with ten members 822, it should be understood that the invention is not limited to a specific number of members in the accordion assembly, and that fewer or more may be provided as desired to provide an overall desired length. The invention is not limited to any particular disposition of the interface between the lower end of the accordion assembly and the slotted guide tab 830, which may comprise member 822 being disposed on one side of the guide tab, member 822 having an interface that straddles guide tab 830, or an interface in which the guide tab is slotted or otherwise comprises two portions having a space therebetween to receive the member. The interface between the translating rotating pin connection and the slot may further comprise an engageable and disengageable mechanism (not shown), such as a lever, pin, clamp, etc. to delimit travel of the pin, in particular a mechanism to delimit translation of the pin in an upward direction when the barrier is in a deployed configuration, to provide additional stability to the barrier.

Figure 8A:
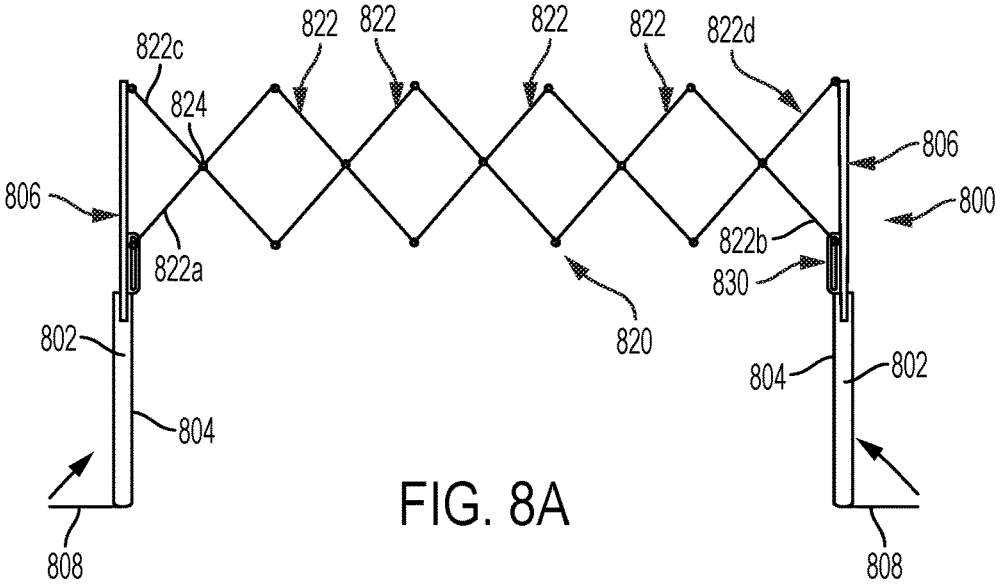
FIG. 8A is a schematic side view drawing of another embodiment of the invention, having telescoping legs.
Figure 8D:
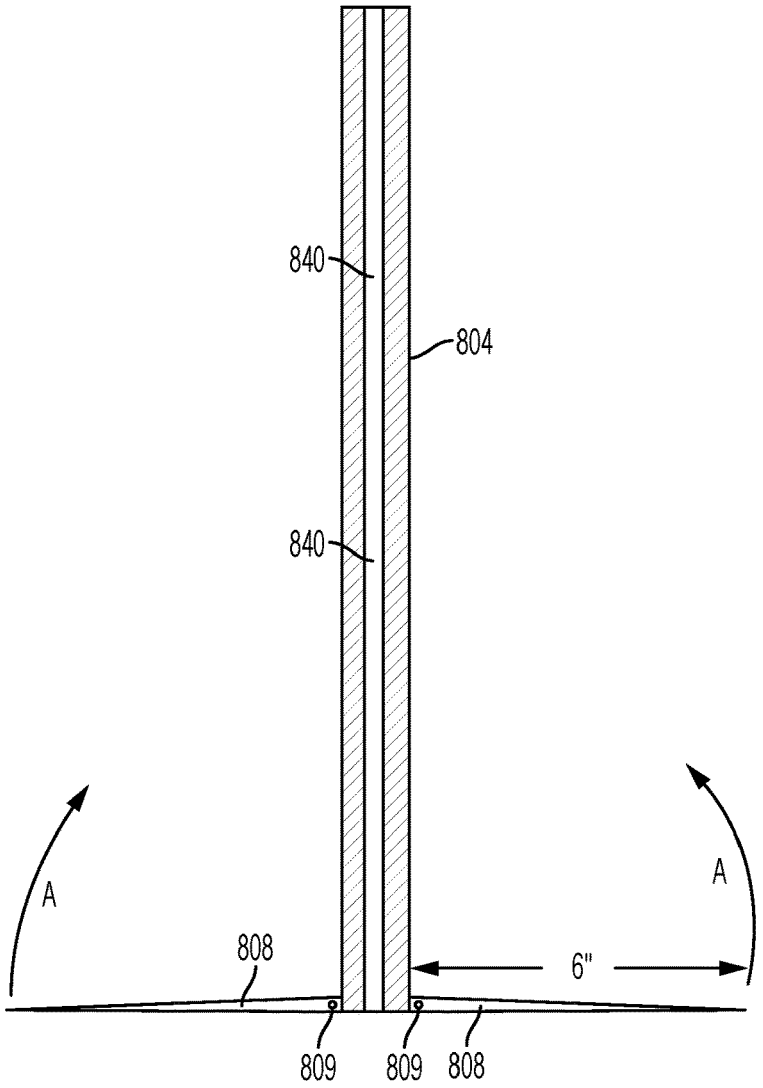
FIG. 8D is a schematic close up drawing of a front view of a lower stanchion portion of an exemplary leg of the embodiment depicted in FIG. 8A.
Figure 8B:
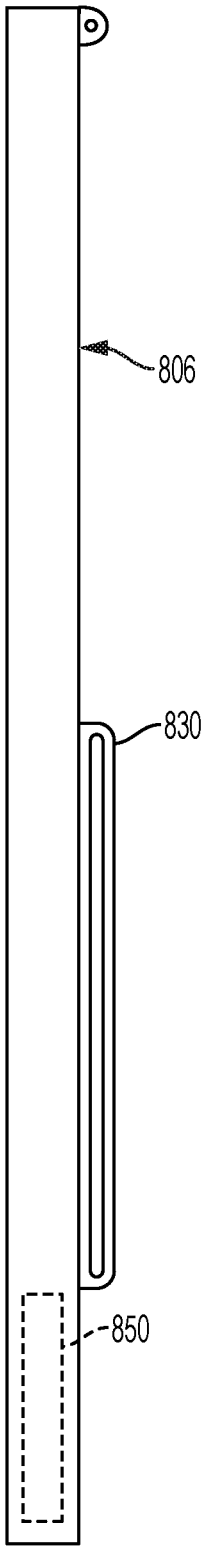
FIG. 8B is a schematic close up drawing of a side view of an upper stanchion portion of an exemplary leg of the embodiment depicted in FIG. 8A.
Figure 8C:
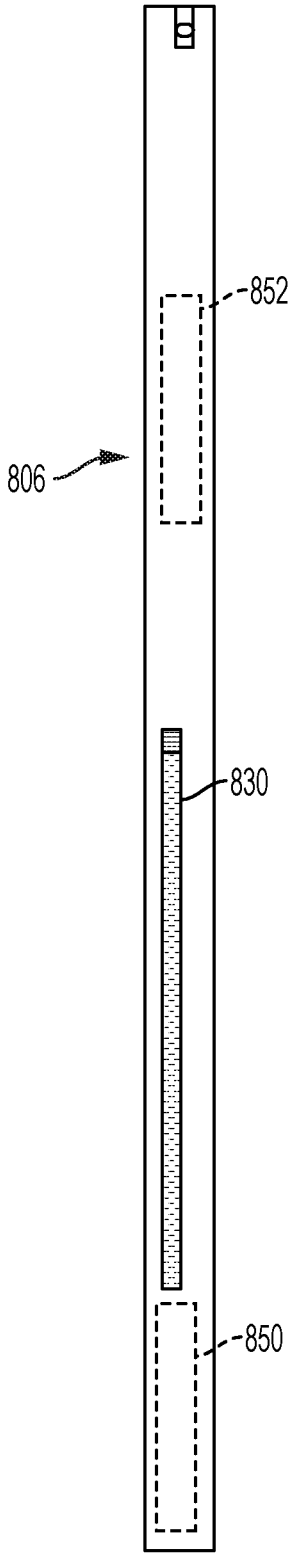
FIG. 8C is a schematic close up drawing of a front view of the upper stanchion portion of FIG. 8B.

A battery compartment and/or storage area 850 for a cord with a connector (e.g. USB, cigarette lighter adapter) for attachment to a mating connector connected to the vehicle battery, as are known in the art, may be provided in one or both of the upper stanchions (at any location therein, including but not limited to the location depicted in FIGS. 8B and 8C. Wiring connecting the lights (such as LED lights) on the accordion section may also run from the power source (battery and/or cords) to the lights connected in series on the accordion section. One or more control modules 852, if any, such as those described herein below, may also be disposed in either or both of the upper stanchions, including but not limited to the location depicted in FIGS. 8B and 8C. The upper stanchion may be of box tube construction, such as aluminum, steel, plastic, or the like, that is hollow to facilitate positioning of such internal components.

Figure 8E:
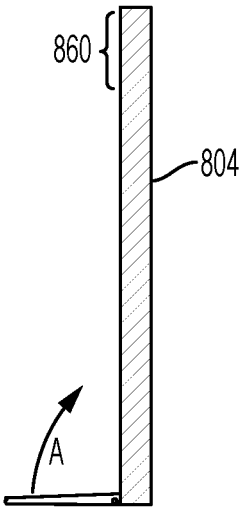
FIG. 8E is a schematic close up drawing of a side view of the lower stanchion portion of FIG. 8D.

Lower stanchion 802, as depicted in FIGS. 8D and 8E, has an internal dimension sized to receive the outer dimension of the upper stanchion, and comprises a slot 840 configured to receive the guide tab 830, Thus, guide tab 830 translates in slot 840 as the upper stanchion moves from a storage position in which the majority of the upper stanchion is positioned inside the lower stanchion, to a deployed position in which the majority of the upper stanchion is telescoped above the lower stanchion, with an overlapping portion 860 contained inside the lower stanchion for stability. The interface between the upper and lower stanchions in the overlapping portion may comprise any stabilizer or locking mechanism (not shown) known in the art for stabilizing or retaining a set of telescoping tubes in the telescoping position, such as a clamp, a mating protrusion and detent arrangement, a pin, a locking screw, or the like, without limitation.

Preferably, each member 822 has disposed therein or thereon one or more lights. In preferred embodiments, each light is disposed in the member to be visible from both sides of the member. Thus, in use, the barrier may be configured so that the lights always form arrows that point in only one direction, such that the user can set up the gate so that the arrows point in the preferred direction to direct traffic safely away from the barrier from both sides. In other embodiments, however, the lights may be visible from only side. In still other embodiments, the barrier may have lights that form arrows capable of pointing in either direction, visible from one or both sides, and may have a switch on the barrier for selecting the light pattern. In the latter design with configurable lighting patterns, the lights may be set to point in only one direction, to direct traffic to one side, or to point from the middle in both directions, to direct traffic around the barrier, such as in an instance in which the disable vehicle is in the middle of the road. In some embodiments, the lights may be connected to a control module 852 operable to cause the lights to flash, to scroll in a scrolling arrow configuration, or in any number of combinations or permutations. In other, lower cost designs, the lights may be configured to point in only a single direction.

Figure 9:
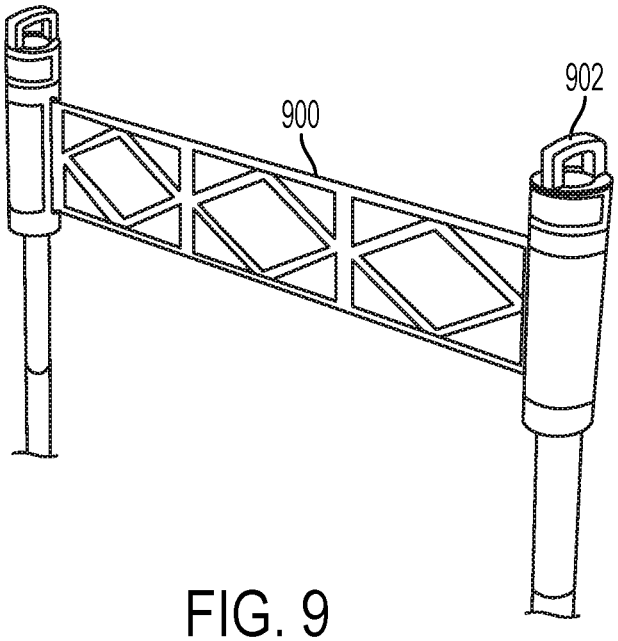
FIG. 9 is a schematic perspective view drawing of an exemplary 2-leg roll-type roadside barrier embodiment.
Figure 10A:
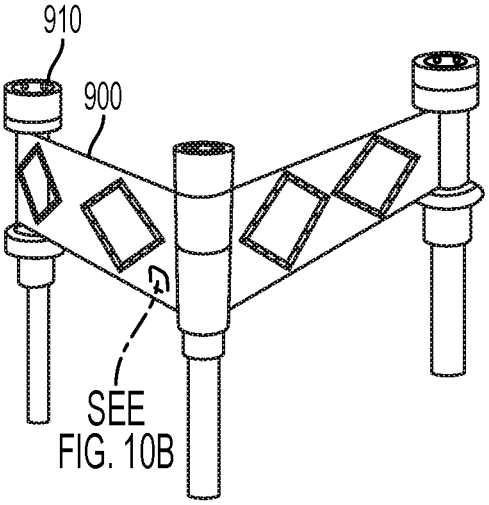
FIG. 10A is a schematic perspective view drawing of an exemplary 3-leg roll-type roadside barrier embodiment.
Figure 10B:
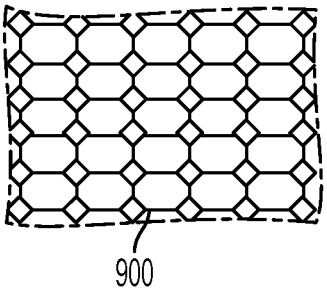
FIG. 10B is a close up of exemplary mesh material used in the embodiment depicted in FIG. 10A.

In other embodiments, depicted in FIGS. 9. 10A and 10B, the lighted portion of the barrier may comprise a mesh panel 900 that is wound onto the stanchions in a rolling configuration, such as a spring-biased configuration on a self-retracting reel, as is well known in the art typically found in window shades and tape measures, for permitting rolling and unrolling for storage and deployment. Although depicted in a two-leg configuration in FIGS. 9 and a threeleg configuration in FIG. 10A, it should be understood that any of the embodiments discussed herein may be provided in configurations with only two legs or more than two legs. As depicted in FIG. 9, the tops of the stanchions may have handles 902 or, as depicted in FIG. 10A, may provide a user interface 910 with switches for turning on and off or changing the lighting pattern of the lights.

Figure 11:
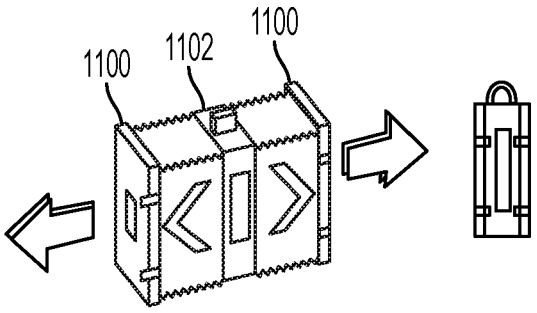
FIG. 11 is a schematic perspective view drawing of an exemplary suitcase roadside barrier embodiment.

In still another embodiment, depicted in FIG. 11, the lighted section may be integrated into a suitcase configuration in which opposite ends 1100 of the suitcase may be separated from one another in a deployed configuration, such as shown in which the opposite ends serve as legs of the frame that are translatable relative to a middle leg 1102 to create a 3-leg configuration, or in a two-leg configuration with no middle leg (not shown). Thus, the overall configuration of frame and the legs thereof may comprise any number of variations, as may the configuration of the assembly disposed between the legs of the frame.

It should be understood that any of the elements shown herein in one exemplary embodiment may be used in connection with any of the other embodiments. The lighting may be provided in the form of flexible strip lighting, as is known in the art, or a plurality of discrete point sources may be installed and connected in series in the lighted structure. Stabilization legs having deployed and storage configurations may be provided in any configuration known in the art.

Figure 12:
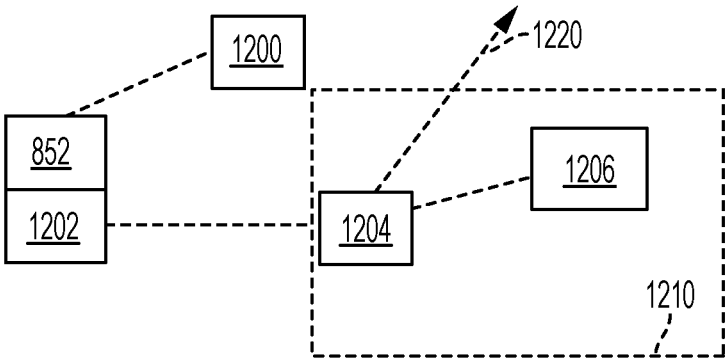
FIG. 12 is a schematic view of an exemplary system comprising a control module for the roadside barrier integrated with a mobile device and communications network.

As depicted in FIG. 12, any of the powered embodiments described herein may comprise one or more controllers 852 disposed in the barrier that may comprise part of an overall system. One such controller may simply provide controls for controlling the lighted elements 1200, and may provide a user with a plurality of lighting configurations (e.g. solid lit, flashing lit, scrolling arrow, left arrow, right arrow, left and right arrows diverging from a mid-point, without limitation). The same controller, or a different controller or different module within the controller, may be configured with a communication module 1202 (e.g. a Bluetooth® wireless communications module, a USB port configured to attach via a wired connection to a phone, without limitation to any particular exemplary embodiment). The communications module 1202 may further integrate with computer hardware and software 1210 (e.g. a mobile device 1204 such as a smart phone programmed with application software, such as an "app," which may comprise a first software portion resident on the mobile device 1204, and a second software component resident "in the cloud" 1206 and communicatively connected to the mobile device via a wireless communications protocol, such as are commonly used by mobile phones). A controller integrated with an "app" may include functionality for controlling the lighting configuration or for sending an alert based upon deployment of the barrier. So, for example, sensors in the controller may be configured to detect when the barrier is in the deployed configuration, and the controller may be configured to send an alert 1220 to a predetermined address. For example, the alert may comprise a text or phone call to a designated telephone number of one or more family members or friends or 911 or a traffic advisory network (such as a traffic advisory network deployed by navigation software apps (e.g. Waze®, Google Maps®, and the like), in which case the app may further use the GPS function of the mobile device to indicate position of the user, and that position may be provided as part of the app. Thus, users of traffic apps may be automatically alerted to a disabled vehicle using the deployed device.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A portable roadside barrier having at least a first collapsed configuration and a second extended configuration, the roadside barrier comprising:

a frame, the frame comprising a first section comprising at least a first set of legs and an assembly therebetween, and a second section comprising at least a second set of legs and a second assembly therebetween, the first section and the second section joined by a hinge, the frame and each of the first and second assemblies having a first surface and a second surface, the frame having telescoping legs comprising an upper stanchion portion and a lower stanchion portion, the frame configurable to be disposed as a warning barrier between vehicular traffic and a vehicle or individual, the assembly extending between the legs comprising a plurality of members connected to one another at rotating pin connections to form an accordion assembly in which the plurality of members form a plurality of X shapes;

one or more stabilizing members configurable to permit the barrier to stand in an upright position a plurality of light emitting elements disposed on at least the first surface of the assembly along the plurality of X-shapes or portions thereof, the plurality of light emitting elements arranged to form a plurality of illuminated indicator arrows emitting light in a first general direction away from the first surface of the assembly, including arrows pointing in a left direction and arrows pointing in a right direction; and an interface disposed on the frame, the interface configured to control the plurality of light emitting elements to operate in a first mode that sequentially illuminates the indicator arrows pointing in the left direction to create an illusion of a moving arrow to the left, a second mode that sequentially illuminates the indicator arrows pointing in the right direction to create an illusion of a moving arrow to the right, and a third mode that sequentially illuminates the indicator arrows pointing in both the left and the right directions to create an illusion of arrows simultaneously moving from a middle location to both the right and the left directions.

2. The portable roadside barrier of claim 1, wherein the roadside barrier has a plurality of extended configurations in which a distance between two of the plurality of adjacent legs is at a maximum in a fully-extended configuration, and the distance between the adjacent legs is less than the maximum in one or more partially-extended configurations.

3. The portable roadside barrier of claim 1, wherein the one or more stabilizing members comprise one or more stabilizing feet at the base of each leg.

4. The portable roadside barrier of claim 1, further comprising one or more receptacles attached to the frame, each receptacle adapted to receive a flashflight or worklight and configurable to point a beam from the flashlight or worklight in a desired direction, including in a second direction opposite the first general direction.

5. The portable roadside barrier of claim 4, wherein each receptacle adapted to receive a flashlight or worklight comprises a ball joint.

6. An alert system comprising the portable roadside barrier of claim 1 and a mobile device, the portable roadside barrier and the mobile device configured to establish a wireless communication link with one another, the mobile device configured to connect to a wireless communication network, the mobile device programmed with instructions for receiving a signal from the portable roadside barrier controller and sending an alert over the wireless communication network signifying a disabled vehicle in response to receipt of the signal from the portable roadside barrier indicating the barrier is in a deployed configuration.

7. The system of claim 6, wherein the mobile device is programmed with instructions for sending the alert over the wireless communication network to a traffic advisory network.

8. The system of claim 7, wherein the mobile device is programmed with instructions for sending the alert over the wireless communication network to a designated telephone number.

9. The system of claim 8, wherein the mobile device is programmed with instructions for sending the alert over the wireless communication network to the designated telephone number in the form of a text message.

10. The system of claim 6, wherein the mobile device further has a GPS function and is programmed with instructions for sending position information as part of the alert.

* * * * *